United States Patent [19]

Leonian

[11] 4,350,283

[45] Sep. 21, 1982

[54] CENTRIFUGAL ELUTRIATOR ROTOR

[75] Inventor: Armen L. Leonian, Woodside, Calif.

[73] Assignee: Beckman Instruments, Inc., Fullerton, Calif.

[21] Appl. No.: 164,983

[22] Filed: Jul. 1, 1980

[51] Int. Cl.[3] ..... B04B 11/00

[52] U.S. Cl. ..... 233/26; 233/1 R; 233/16; 422/72

[58] Field of Search ..... 233/26, 17, 16, 19 R, 233/19 A, 21, 22, 1 R, 1 A, 27, 28, 1 D, 2; 422/72, 102

[56] References Cited

U.S. PATENT DOCUMENTS

| | | | |
|---|---|---|---|
| 2,616,619 | 11/1952 | MacLeod | 233/26 |
| 3,675,846 | 7/1972 | Drucker | 233/26 |
| 3,856,470 | 12/1974 | Cullis | 422/72 |
| 4,098,455 | 7/1978 | Ammann | 233/26 |
| 4,098,456 | 7/1978 | Bayham | 233/26 |

*Primary Examiner*—Robert W. Jenkins

*Attorney, Agent, or Firm*—R. J. Steinmeyer; F. L. Mehlhoff; Al A. Canzoneri

[57] ABSTRACT

The present invention provides a centrifuge rotor adapted for continuous separation of specific particles from mixed populations thereof by a process of centrifugal elutriation. In the rotor, elutriation cells abut a central spindle having fluid carrying means, and thereby eliminate intermediate conduits and seals therefor, thus reducing the likelihood of leakage because of faulty aperture registration or failure of the sealing means.

8 Claims, 3 Drawing Figures

CENTRIFUGAL ELUTRIATOR ROTOR

BACKGROUND OF THE INVENTION

The present invention relates to the field of centrifuges and more particularly to a centrifuge rotor for sorting particles by the process of centrifugal elutriation.

Among the many methods known for separating biological cells by reference to their comparative sedimentation velocities, centrifugal elutriation is becoming a widely favored method. Centrifugal elutriation, which has also been called "Counter Streaming Centrifugation" in some scientific literature, is a continuous flow process whereby liquid buffers are pumped through a cavity within a rotor cell as counterflow mediums in the process of separating and collecting the particles of interest.

In the design of prior art elutriation rotors, a typical practice was to house the elutriation cells in cavities in the rotor which were disposed symmetrically in relation to a spindle fixedly mounted at the central axis of the rotor. In addition to providing support for the rotor on the drive shaft, the spindle also contained the necessary inlet and outlet fluid passageways for conveying fluids to the rotor during its rotation. These fluids were introduced and recovered through ports provided in a rotatable seal extending into a stationary bearing positioned at the upper end of the spindle. Fluids introduced at the inlet port of the stationary bearing enter the inlet passageway of the spindle. The inlet passageway of the spindle intersects with a passage through the rotor which, in turn, communicates with the inlet passageway of the elutriator cell, leading to the entrance to the elutriation chamber (i.e., separation chamber). The outlet portion from the cell communicates with a passage through the rotor that, in turn, intersects with the outlet passage through the spindle.

The foregoing arrangement employs a relatively large number of passageways and aperture interfaces. This necessarily increases the risk of leakage through O-ring failure or misalignment of passageway apertures. The design also imposes a relatively severe constraint on the length of the elutriation cell that can be employed thereby limiting the volume as well as the shape of the separation chamber that may be used therein.

SUMMARY OF THE INVENTION

In accordance with the present invention, a centrifuge rotor adapted for continuous separation of specific particles from mixed populations thereof, is provided. The rotor of the invention is adapted to be supported on a centrifuge drive shaft and rotated thereby, and has elutriator cell housing means with at least two equally spaced-apart elongated cavities disposed symmetrically with respect to the axis of rotation of the rotor.

A fluid delivery spindle extends upwardly along the axis of rotation of the rotor, and provides fluid inlet and fluid outlet passages and apertures which communicate directly with the inlet and outlet apertures of the elutriator cells disposed in the cavities of the rotor.

Accordingly, the invention eliminates the need for passageways through the rotor as intermediate conduits between the elutriator cell and the spindle. The effect of this change is to reduce the number of seals needed between the elutriator cell and the spindle. In addition, since the elutriator cells of the present invention directly abut the spindle, much greater freedom is possible in designing the shape or volume of the cell chamber. And finally, by eliminating the rotor passageways, it becomes unnecessary to employ only inert materials in the design of the rotor which supports the elutriator cell since the fluids no longer come into contact with the rotor material.

These and other features of the invention will become more apparent after reference to the accompanying drawings and following detailed description.

DETAILED DESCRIPTION

Figure 1:
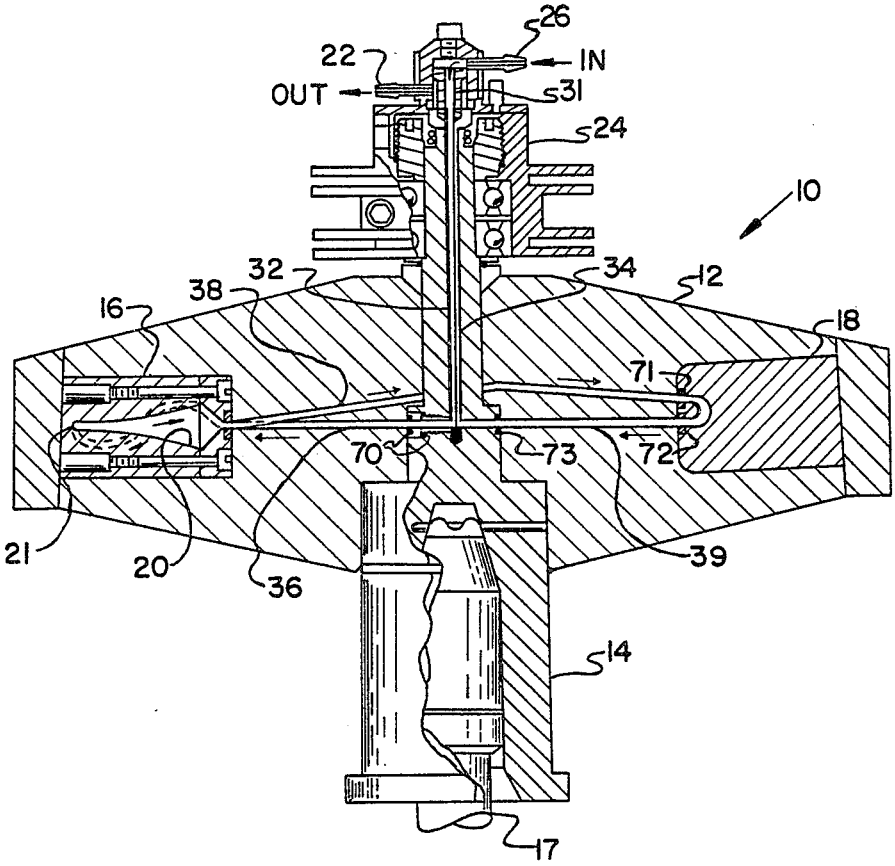
FIG. 1 PRIOR ART
FIG. 1 is a somewhat schematic cross-sectional elevation view of an elutriator rotor according to the prior art illustrating in general the passageways.

A prior art centrifugal elutriator rotor 10 and delivery mechanism is illustrated in FIG. 1 in somewhat schematic form to show the fluid passageways employed for introducing liquid to and from an elutriator cell. Rotor assembly 12 is supported by spindle 14 which is adapted to be supported and rotated by a centrifuge drive shaft 17. Included in rotor 12 are elutriator cells 16 and 18. It will be noted that only one elutriation cell 16 contains a separation chamber 20. In the illustrated example of the prior art, elutriation cell 18 is called a bypass cell which serves to balance the rotor, and also to enable fluids in the circuit to reach passageways in the spindle 14 and to exit from the elutriator at outlet port 22, which is located on stationary member 24 through which fluids are pumped.

A stationary member 24 is provided in order to enable the elutriator to be continuously loaded and unloaded while rotating. By the use of bearings and rotating seals, inlet port 26 can be maintained stationary by the light drag of its inlet line.

In operation, fluid is pumped into inlet 26 of stationary member 24. Upon admission through inlet 26, the fluid encounters an intersecting passageway 31 which, in turn, connects with vertical passageway 32 of spindle 14 by means of a rotary seal. At the bottom of passageway 32, the fluid passageway makes a 90 degree turn and exits the spindle to flow through an orifice in a passageway 36 of rotor 12. The sealing of this junction is accomplished by use of face-to-face O-rings 70. Passageway 36 communicates with the small end 21 of separation chamber 20 through an O-ring (not visible in the drawing). It will be noted that the direction of flow through the separation chamber is counter to the direction of the centrifugal force generated during centrifugation. After flowing through separation chamber 20 the fluid exits the elutriator cell by connecting with an O-ring sealed passageway 38 in rotor body 12. The fluid enters bypass cell 18 through O-ring 71 which returns it through O-ring 72 and passageway 39 of the rotor body 12. Passageway 39 connects through O-ring 73 in spindle 14 and joins with vertical passageway 34. Passageway 34 is joined by a rotating seal to outlet port 22.

Figure 2:
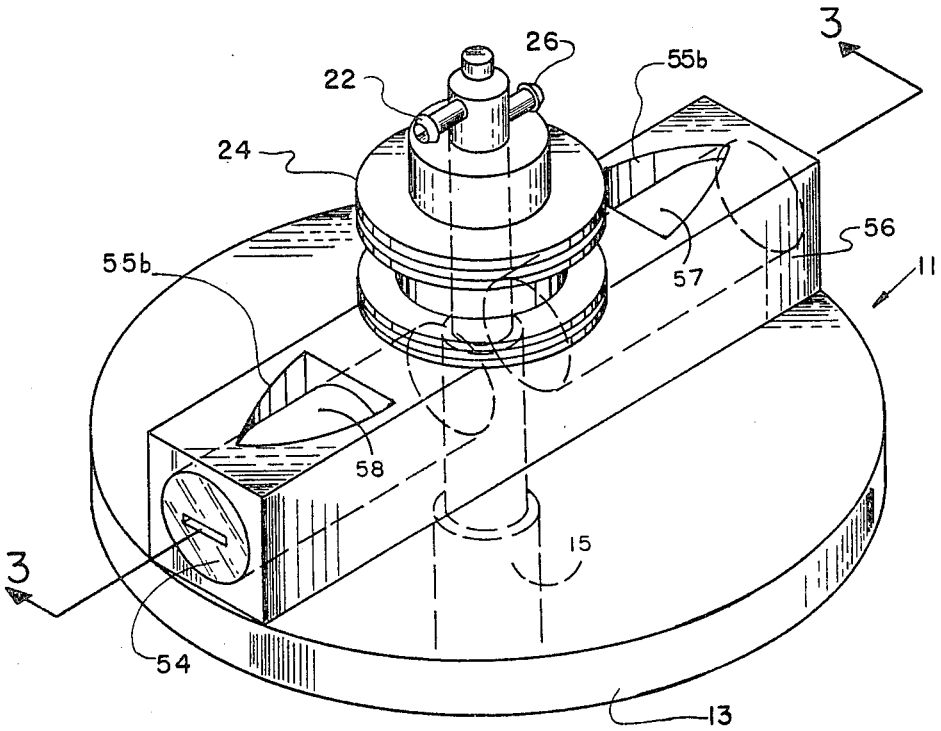
FIG. 2 is a perspective view of the elutriator rotor of the present invention.

Referring now to FIG. 2, there is shown a perspective view of the rotor of the invention. Circular rotor base 13 includes an elutriator cell housing 56 symmetrically located with respect to the central axis of the rotor. Housing 56 contains viewing ports **55*b* and 55*a*** on its top and bottom surfaces respectively to permit visual inspection of the elutriation process. A strobing light source (not shown), which is capable of being synchronized with the rotation of rotor 13, may be positioned under the rotor so that light rays 61 from the strobe passes through aperture 53 in rotor 13, through lower viewing port 55*a*, through the elutriator cell and out of upper viewing port 55*b* to the viewer's eye.

Figure 3:
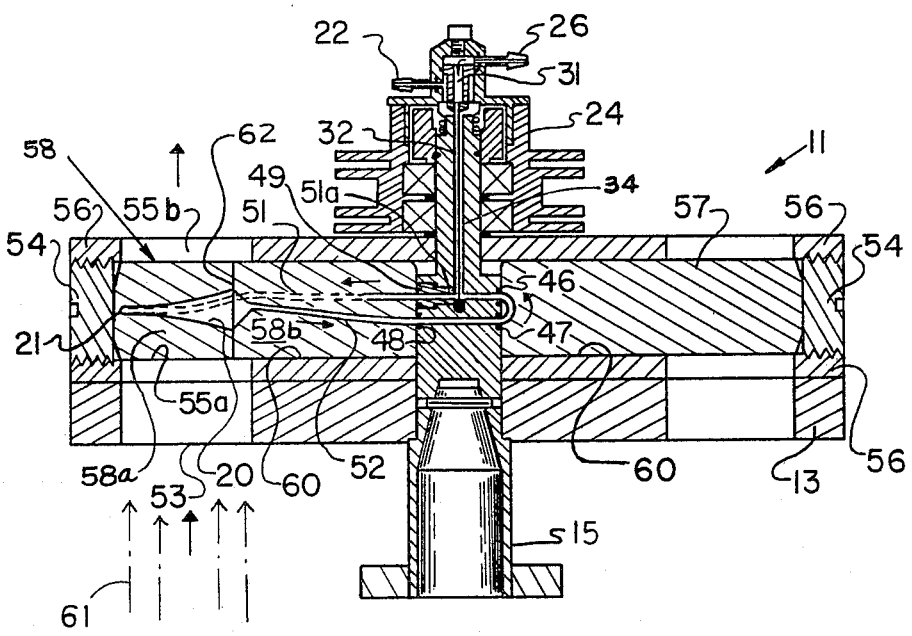
FIG. 3 is a cross-sectional view of the elutriator rotor of FIG. 2 taken on the line 3—3.

Referring now to FIG. 3, there is shown in cross-section the centrifugal elutriator rotor 11 of the present invention. As shown, rotor base 13 is rigidly attached to spindle 15 which connects with the centrifuge drive shaft (not shown) for driving the rotor. Rotor housing means or member 56 in conjunction with end members 54 form at least two elongated elutriator cell cavities 60 disposed symmetrically on each side of spindle 15 and with respect to the axis of rotation of the rotor. Within each cavity of the rotor housing 56 there is positioned an elutriator cell 57 and 58. Elutriator cell 58 includes first and second cell parts 58*b* and 58*a* respectively, with gasket means 62 interposed between the cell parts to prevent leakage at their juncture. A screw type of end plate 54 exerts a force on the elutriator cell to maintain sufficient pressure on the face-to-face O-ring seals 46, 47, 48 and 49 between the spindle 15 and the elutriator cells.

In operation, fluid is pumped into inlet port 26 of stationary member 24. The fluid immediately encounters intersecting passageway 31 which connects by means of a rotating seal to passageway 32 in spindle 15. Passageway 32 ends at an intersection with passage 51*a*. It will be noted that passageway 51*a* immediately joins passageway 51 in the elutriator cell relying on a single O-ring interface 49 to complete the connection. The fluid flows into the small end 21 of separation chamber 20.

Upon filling chamber 20, the fluid passes through the cell by passageway 52 leading through spindle 15 and thereafter redirected by bypass cell 57 to an upward passage 34 in spindle 15 and then ultimately exiting through outlet port 22 on stationary bearing 24. It will be noted that by interfacing elutriation cells 58 and 57 directly with the spindle 15 that the number of face-to-face aperture connections have been cut in half, now requiring only four O-rings and greatly reducing the likelihood of leakage and also certain material compatibility problems. Contact pressure for these face-to-face aperture connections is derived by clamping means such as end caps 54 which can employ screw means or spring means to maintain cells 58 and 57 closely abutted to spindle 15.

Attention is also directed to the fact that it is possible to replace bypass cell 57 with a cell having one or more separation chambers as in cell 58; such as decision must, of course, be influenced by the particular type of separation process and particles to be identified by centrifugal elutriation.

The invention has been described in what is believed to be its most practical form; however, it will be recognized that changes and modifications may be made by those skilled in the art without departing from the true spirit and intended scope of the invention which is disclosed here for the purpose of protecting by means of a Letters Patent thereon.

I claim:

1. A centrifuge rotor adapted for continuous separation and collection of specific particles from mixed populations thereof, comprising:

a rotor adapted to be supported on a centrifuge drive shaft for rotation thereby;

said rotor having elutriator cell housing means with at least two equally spaced-apart elongated cavities disposed symmetrically with respect to the axis of rotation of said rotor;

a fluid delivery spindle disposed in said rotor and extending along the axis of rotation thereof, said spindle having fluid inlet and outlet passages therethrough, said passages having inlet and outlet apertures communicating with each of said elongated cavities;

elutriator cells disposed in at least two of said elongated cavities, said elutriator cells having inlet and outlet openings on one end thereof registering with said corresponding apertures in said spindle in face-to-face contact therewith for receiving and delivering fluid to and from said spindle passages;

said spindle having one end connecting with a stationary housing having rotating seals and stationary inlet and outlet ports to enable continuous loading and unloading of said elutriator cells while said rotor is rotating.

2. The centrifuge rotor recited in claim 1 further comprising O-ring sealing means at each of said inlet and outlet apertures in face-to-face contact with said elutriator cell.

3. The centrifuge rotor as recited in claim 2 further comprising:

means at the end remote from said rotor axis of each of said elongated cavities for applying a force along the longitudinal axis of said elutriator cell contained therein, and thereby enabling said O-ring sealing means to make sealing contact with said elutriator cell.

4. An elutriator cell adapted for use in the cavity of a centrifuge rotor comprising:

a transparent elutriator cell having fluid passages with inlet and outlet apertures disposed on one end face thereof;

said apertures in close registration and abutting contact with O-ring seals in corresponding apertures contained in the spindle of said rotor;

an elutriation chamber contained in at least one of each opposing pair of elutriation cells.

5. The elutriator cell of claim 4 wherein said cell is made of a transparent plastic.

6. The elutriator cell of claim 4 wherein said material is epoxy.

7. An elutriator cell adapted for use in the cavity of a centrifuge rotor having a fluid delivery spindle extending upwardly along the axis of rotation of the rotor, comprising:

a first cell part having fluid passages with inlet and outlet apertures disposed on one end face thereof;

said one end face of said first cell part adapted to abut in direct contact with said fluid delivery spindle, wherein said one end face of said first cell part has apertures in corresponding registration with corresponding inlet and outlet passages from said spindle;

sealing means provided around the apertures in said spindle in corresponding registration with said apertures of said one end face of said first cell part;

a second cell part adapted for connection to the other end of said first cell part;

clamping means for joining said second cell part to the other end of said first cell part;

gasket means to prevent leakage in the joining of said first and second cell parts;

a separation chamber formed in said first and second cell parts, wherein inlet and outlet passages are suitably registered, one with the other, and said gasket means effects a seal at such junction thereof.

8. A centrifuge rotor for continuous separation and collection of specific particles from mixed populations thereof wherein said rotor is adapted for viewing said process of separation and collection comprising:

a rotor adapted to be supported on a centrifuge drive shaft for rotation thereby;

said rotor having elutriator cell housing means with at least two equally spaced-apart elongated cavities disposed symmetrically with respect to the axis of rotation of said rotor;

a fluid delivery spindle disposed in said rotor and extending along the axis of rotation thereof, said spindle having fluid inlet and outlet passages therethrough, said passages having inlet and outlet apertures communicating with each of said elongated cavities;

transparent elutriator cells disposed in at least two of said elongated cavities, said elutriator cells having inlet and outlet openings on one end thereof registering with said corresponding apertures in said spindle in face-to-face contact therewith for receiving and delivering fluid to and from said spindle passages;

said spindle having one end connecting with a stationary housing having rotating seals and stationary inlet and outlet ports to enable continuous loading and unloading of said elutriator cells while said rotor is rotating; and synchronous light means for passing light through said rotor and said transparent elutriator cells.

* * * * *